US005990603A

United States Patent [19]

Kim et al.

[11] Patent Number: 5,990,603

[45] Date of Patent: Nov. 23, 1999

[54] CATHODE STRUCTURE WITH REDUCED CAPACITANCE

[75] Inventors: Chang-seob Kim, Suwon; Bong-uk Jeong, Seoul, both of Rep. of Korea

[73] Assignee: Samsung Display Devices Co., Ltd., Kyungki-do, Rep. of Korea

[21] Appl. No.: 08/889,156

[22] Filed: Jul. 7, 1997

[30] Foreign Application Priority Data

Jul. 8, 1996 [KR] Rep. of Korea ..... 96-27536

[51] Int. Cl.[6] ..... H01J 1/30; H01J 19/22

[52] U.S. Cl. ..... 313/309; 313/336

[58] Field of Search ..... 313/309, 336, 313/351, 442, 495

[56] References Cited

U.S. PATENT DOCUMENTS 4,178,531 12/1979 Alig ..... 313/309

5,719,477 2/1998 Tomihari ..... 313/336

5,763,987 6/1998 Morikawa et al. ..... 313/309

*Primary Examiner*—Michael Day

*Attorney, Agent, or Firm*—Lowe Hauptman Gopstein Gilman & Berner

[57] ABSTRACT

A cathode structure of an electron gun for a cathode ray tube includes: a substrate (51); cathode electrode layers (52) formed on the substrate (51) and spaced apart from each other at predetermined intervals; a plurality of metal tips (53); an insulating layer (54) formed on the cathode electrode layers (52) and the substrate (51) to isolate each of the metal tips (53) from each other; a gate electrode layer having a first gate electrode portion (56) having a gate through which the metal tips (53) are exposed and formed on top of the insulating layer (54), and a second gate electrode portion (57) extending horizontally from said first gate portion (56) and divided into several parts by a plurality of gaps (60) for reducing the capacitance between the cathode electrode layers (52) and the second gate electrode portion (57).

5 Claims, 3 Drawing Sheets

CATHODE STRUCTURE WITH REDUCED CAPACITANCE

BACKGROUND OF THE INVENTION

The present invention relates to a cathode structure of an electron gun for a cathode ray tube (CRT), and more particularly, to a cathode ray tube adopting a field emission device.

An indirectly heated or directly heated cathode is used as a thermion emission source in the CRT of existing monitors and televisions. Since the thermion emission material of the conventional cathode structure is heated by a special heating source to emit thermions, certain inherent problems arise. First, the period for emitting the normal thermions is relatively long since the thermion emission material is heated after support members for supporting the thermion emission material is heated with heat generated by the heating source. Accordingly, the time required to form a CRT image increases, for example, up to 8 or 9 seconds.

Second, a thermal drift phenomenon occurs due to the thermal expansion of the support member for supporting the thermion emission material.

Third, to heat the thermion emission material, power consumption of between 2 and 4 watts is required.

To overcome the above-mentioned problems, a cathode structure adopting a field emission device has been devised. Referring to FIG. 1, the cathode structure is comprised of an electrode member 11, an insulating member 12 combined with the electrode member, and a cell 20 installed on the insulating member and having field emission devices.

As shown in FIGS. 2 and 3, the cell 20 comprises a substrate 21 and three cathode layers 22 formed in a predetermined pattern on the substrate 21. A plurality of metal tips 23 for emitting electron beams corresponding to red, green, and blue signals are formed on the cathode layer 22. Each of the metal tips 23 is isolated from each other by an insulating layer 24 having openings 24*a*, and a gate electrode layer 25, having gates 25*a* through which the metal tips 23 are exposed, is formed on top of the insulating layer 24.

In the operation of the conventional cathode structure as constituted above, the amount of electrons emitted from the metal tips 23 is controlled by applying negative or zero voltages to the cathode layer 22 and a positive voltage to the gate electrode layer 25. Since the gate electrode layer 25 is formed on the overall surfaces of the substrate 21, the driving signal is distorted by the capacitance between the gate electrode layer 25 and cathode layer 22.

SUMMARY OF THE INVENTION

To solve the above problems, it is an object of the present invention to provide a cathode structure of an electron gun for a CRT in which distortion of a driving signal for controlling an electron beam emitted from the metal tips can be prevented by reducing the capacitance between a gate electrode and a cathode electrode.

Accordingly, to achieve the above object, there is provided a cathode structure of an electron gun for a CRT, comprising a substrate; cathode electrode layers formed on the substrate spaced at predetermined intervals; a plurality of metal tips for emitting electrons formed on the upper surface of the cathode electrode layer; an insulating layer formed on the cathode electrode layer and the substrate to isolate each of the metal tips from each other; a first gate electrode layer formed on top of the insulating layer and having gates through which the metal tips are exposed; and a second gate electrode layer formed on top of the insulating layer, extending horizontally from the first gate electrode layer, and divided into several parts a gap therebetween.

Also, it is preferable that a cathode lead portion connected to the cathode electrode layer is formed between the insulating layer where the gap is situated.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

Figure 1:
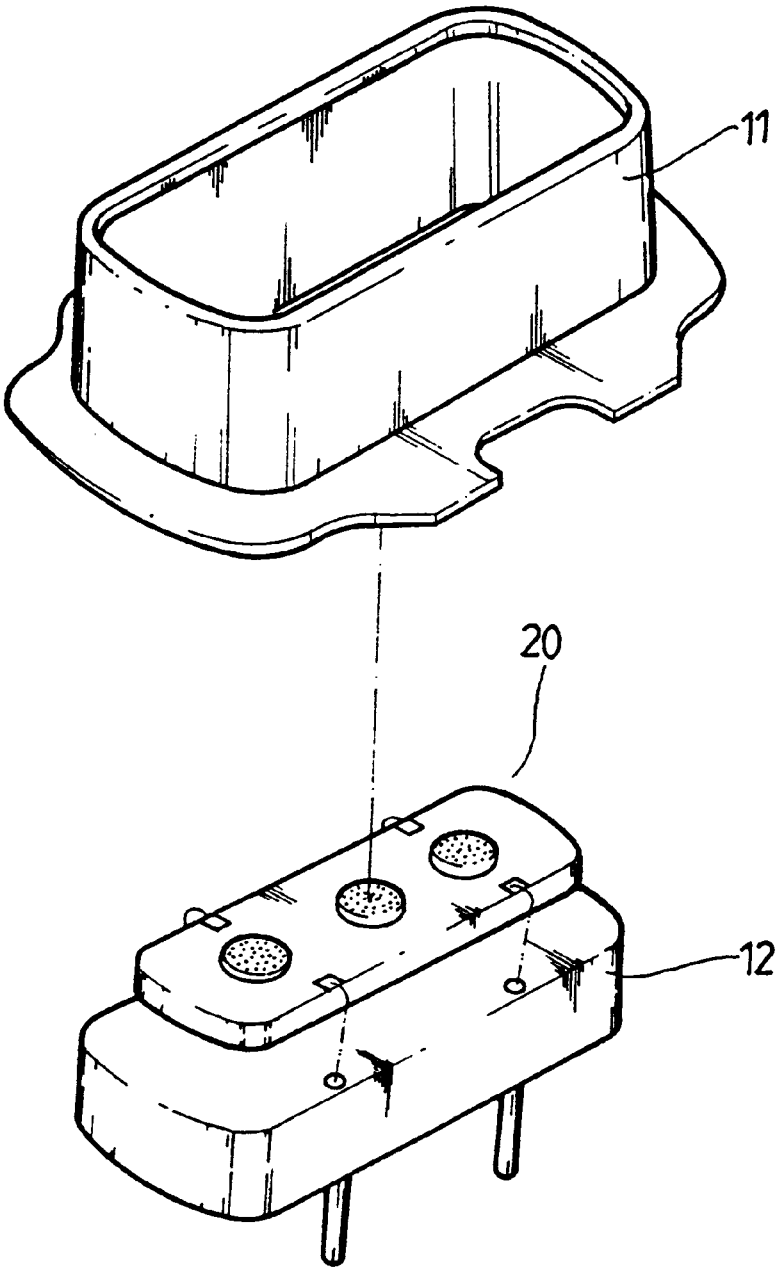
FIG. 1 (PRIOR ART)
FIG. 1 is an exploded perspective view illustrating a conventional cathode structure of an electron gun for a CRT.
Figure 2:
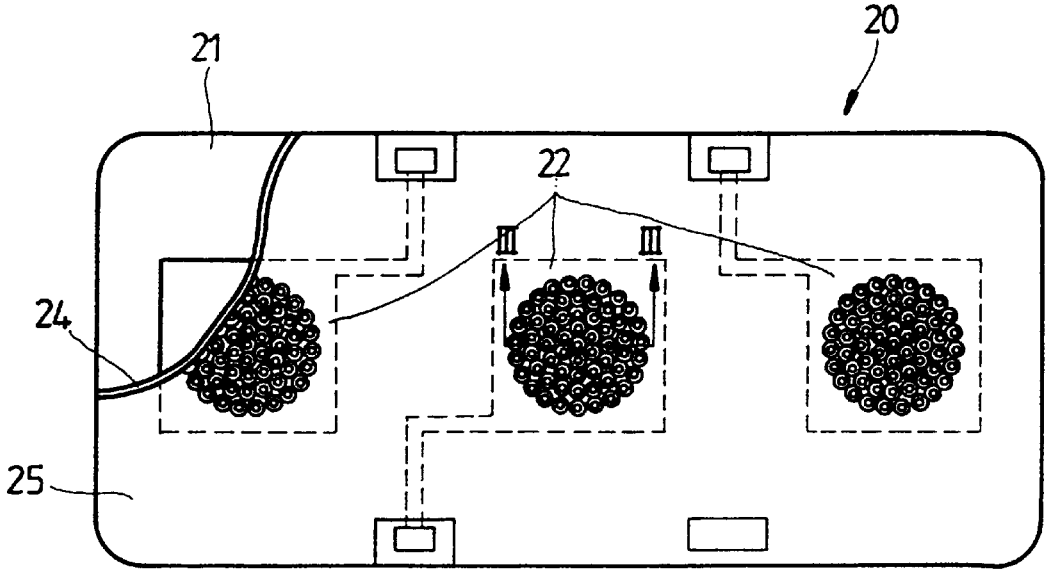
FIG. 2 (PRIOR ART)
FIG. 2 is a plan view illustrating a cell of the cathode structure of an electron gun for the CRT shown in FIG. 1.
Figure 3:
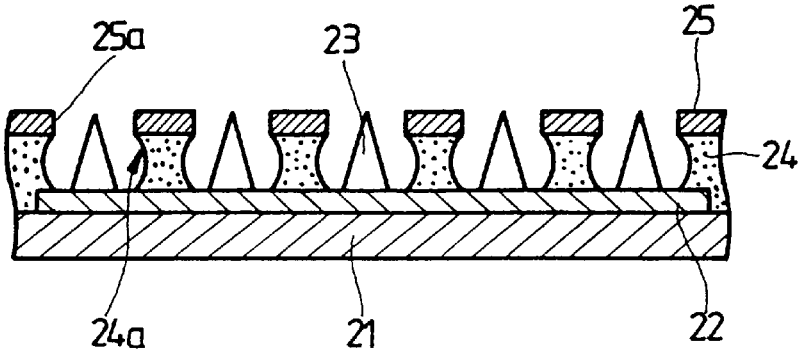
FIG. 3 (PRIOR ART)
FIG. 3 is a sectional view taken along line III—III of FIG. 2.
Figure 4:
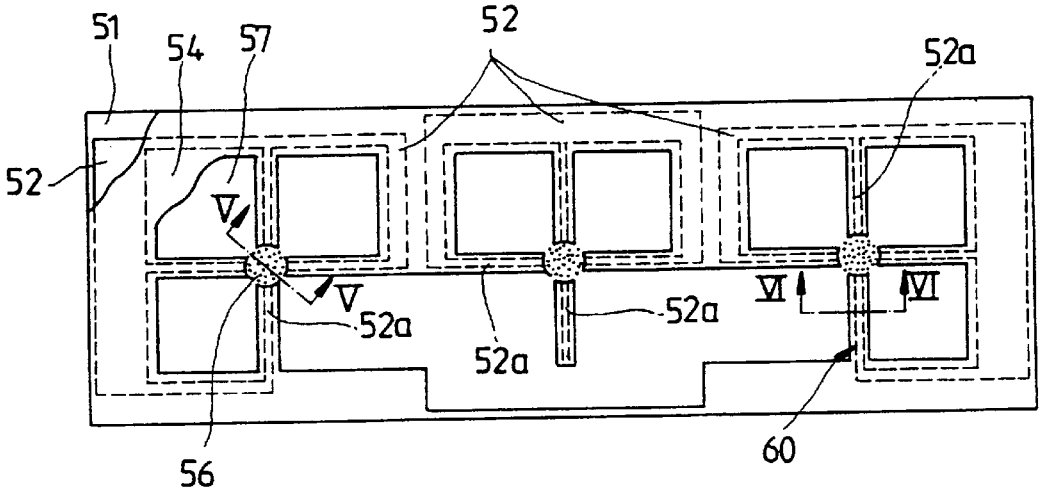
FIG. 4 is a plan view illustrating a cell of a cathode structure of an electron gun for a CRT according to the present invention.
Figure 5:
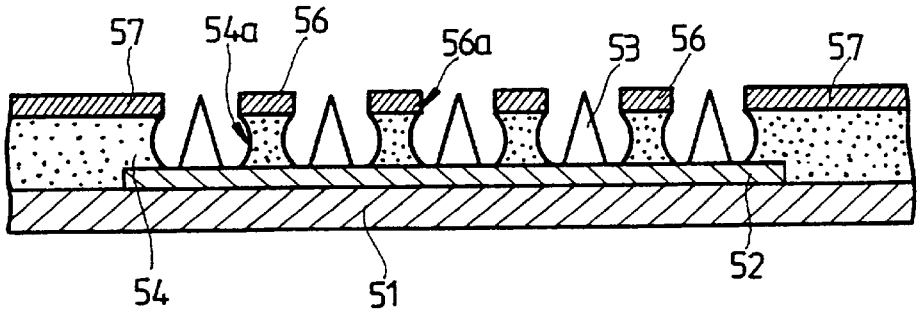
FIG. 5 is a sectional view taken along line V—V of FIG. 4.
Figure 6:
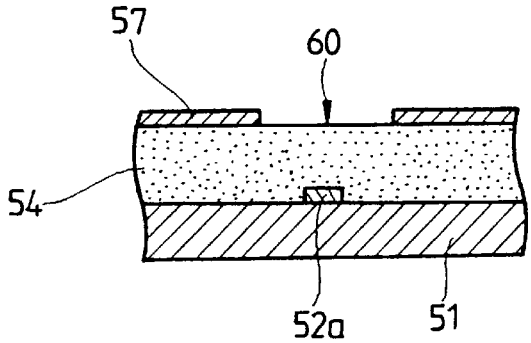
FIG. 6 is a sectional view taken along line VI—VI of FIG. 4.

FIGS. 4 through 6 show an embodiment of the cathode structure of an electron gun for a CRT according to the present invention. Referring to the drawings, the cathode structure includes a substrate 51, three cathode electrode layers 52 formed on the substrate 51 spaced apart from each other at predetermined intervals, and a plurality of metal tips 53 formed on the cathode electrode layer 52 for emitting electrons. Here, cathode lead portions 52*a* extend laterally from the cathode electrode layer 52.

An insulating layer 54 having openings 54*a* is formed on the substrate 51 on which the cathode electrode layer 52 is formed such that the insulating layer 54 isolates each metal tip 53. Also, a first gate electrode layer 56 having gates 56*a* formed so as to expose the metal tips 53 therethrough and a second gate electrode layer 57 extending laterally from the first gate electrode layer 56 are formed on top of the insulating layer 54. The second gate electrode layer 57 is divided into several parts by a gap 60 through which the insulating layer 54 is exposed. The cathode lead portion 52*a* is formed between the lower surface of the insulating layer 54 where the gap 60 is situated and the upper surface of the substrate 51, as shown in FIG. 6.

In the operation of the cathode structure of an electron gun for a CRT according to the present invention as constituted above, a predetermined voltage or a ground voltage is applied to each cathode electrode layer 52 and a positive voltage is applied to the first and the second gate electrode layers 56 and 57, thereby controlling the amount of electrons emitted from the metal tips 53.

According to the present invention, the second gate electrode layer 57 is divided into several parts and there is a gap 60 in the second gate electrode layer 57 over the cathode electrode layer 52 and the cathode lead portion 52*a* so that the capacitance of the gate electrode layer can be reduced. In particular, since the cathode electrode layer 52 is not formed on the lower surface of the insulating layer 54, a charge of electrons can be prevented from accumulating, thereby reducing the capacitance. The reduction in the capacitance of the gate electrode prevents distortion of the driving signal for controlling the electron beam generated from the metal tips.

It is noted that the present invention is not limited to the preferred embodiment described above, and it is apparent that variations and modifications by those skilled in the art can be effected within the spirit and scope of the present invention defined as in the appended claims.

What is claimed is:

1. A cathode structure of an electron gun for a cathode ray tube (CRT), comprising:

a substrate;

cathode electrode layers formed on said substrate and spaced apart from each other at predetermined intervals;

a plurality of metal tips for emitting electrons formed on the upper surface of said cathode electrode layer;

an insulating layer formed on said cathode electrode layer and said substrate to isolate each of said metal tips from each other;

a gate electrode layer having a first gate electrode portion having a gate through which said metal tips are exposed and formed on top of said insulating layer, and a second gate electrode portion formed on top of said insulating layer, extending horizontally from said first sate electrode portion and divided into several parts by a plurality of gaps for reducing the capacitance between said cathode electrode layer and the same.

2. A cathode structure of an electron gun for a CRT as claimed in claim 1, further comprising a cathode lead portion formed between said insulating layer where at least one of said gaps is situated and said substrate and connected to said cathode electrode layer.

3. The cathode structure of claim 2, wherein said at least one gap is positioned on top of the insulating layer and overlies said cathode lead portion.

4. The cathode structure of claim 3, wherein said second gate electrode portion is not formed in the region of said at least one gap.

5. The cathode structure of claim 1, wherein said first gate electrode portion and said second gate electrode portion are coplanar with each other.

* * * * *